United States Patent [19]

Iles et al.

[11] Patent Number: 4,712,643

[45] Date of Patent: Dec. 15, 1987

[54] PARTICULATE TRAP EXHAUST MUFFLER

[75] Inventors: Lawrence F. Iles, Madison; Gary D. Goplen, Stoughton, both of Wis.

[73] Assignee: Nelson Industries, Inc., Stoughton, Wis.

[21] Appl. No.: 15,743

[22] Filed: Feb. 17, 1987

[51] Int. Cl.[4] ..... F01N 3/02

[52] U.S. Cl. ..... 181/231; 181/257; 181/258; 55/276

[58] Field of Search ..... 181/231, 256–258, 181/174; 55/276

[56] References Cited

U.S. PATENT DOCUMENTS

| | | | |
|---|---|---|---|
| 3,073,684 | 1/1963 | Williams, Sr. | 181/257 X |
| 4,108,276 | 8/1978 | Hall et al. | 181/256 |
| 4,162,904 | 7/1979 | Clay et al. | 55/276 |

OTHER PUBLICATIONS

"Urban Bus Application of a Ceramic Fiber Coil Particulate Trap", H. O. Hardenberg, Daimler-Benz AG.

*Primary Examiner*—B. R. Fuller

*Attorney, Agent, or Firm*—Andrus, Sceales, Starke & Sawall

[57] ABSTRACT

A particulate trap exhaust muffler for use with a diesel engine and comprising a casing having an internal wall dividing the casing into an inlet chamber and an outlet chamber. The wall is formed with a plurality of openings and a plurality of generally parallel tubes are disposed within the outlet chamber with one end of each tube being mounted within one of the openings in the divider wall, while the other end of each tube is closed. At least a portion of the length of each tube is formed with perforations or holes. A cylindrical particulate trap is spaced concentrically outward of each tube to provide an annular chamber therebetween. Exhaust gas entering the inlet chamber flows into the tubes and through the perforations into the respective annular chambers to decrease the sound energy, and then passes outwardly through the cylindrical traps where particulate material is trapped and burned off. The exhaust gas then is discharged from the outlet chamber through an outlet.

14 Claims, 3 Drawing Figures

FIG. 1
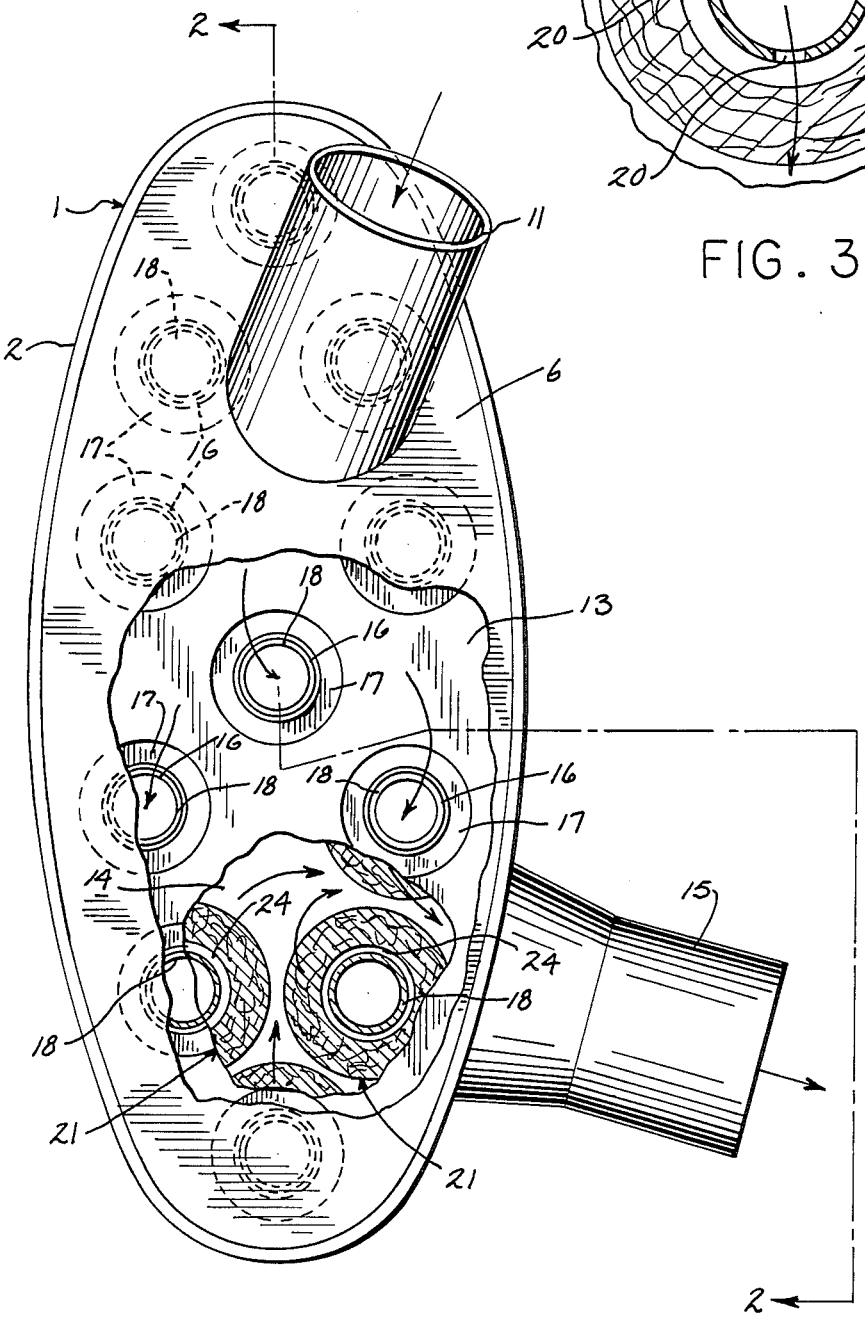
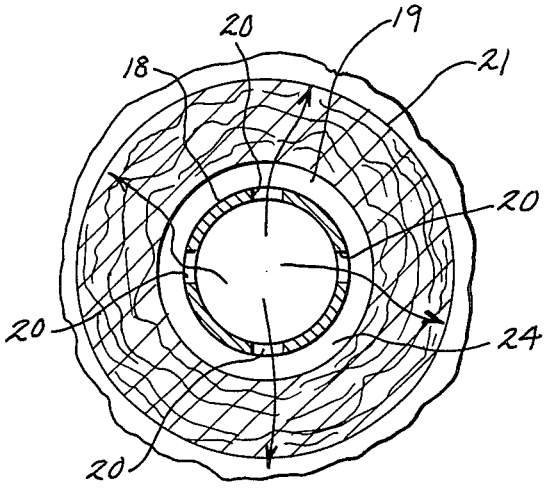
FIG. 3

PARTICULATE TRAP EXHAUST MUFFLER

BACKGROUND OF THE INVENTION

Catalytic particulate traps are frequently used with diesel engines to trap and combust particulate materials and prevent the emission of the particulate material to the atmosphere. The conventional particulate trap is formed of a gas permeable material, such as compressed stainless steel mesh, which is coated with a catalytic agent, such as a noble metal. As exhaust gas flows through the trap, the particulate material will be caught or trapped and at high temperatures the particulate material will be burned off.

The conventional particulate trap includes an outer casing having an internal divider wall which divides the casing into an inlet and outlet chamber. The divider wall is formed with a plurality of openings and a series of cylindrical catalytic units are disposed in the outlet chamber, with one end of each unit being mounted in one of the openings in the divider wall, while the opposite end of each cylindrical unit is closed. The exhaust gas entering the inlet chamber will flow through the openings in the divider wall into the interior of the cylindrical units and then flow outwardly through the units to the outlet chamber. In flowing outwardly through the cylindrical units, the particulate material will be trapped and at high temperature will be burned off.

In the conventional catalytic trap, the cylindrical units are supported from the divider wall by internal metal supports or spiders which merely function to internally support the cylindrical traps, but provide no sound attenuation function.

SUMMARY OF THE INVENTION

The invention is directed to a catalytic particulate trap for a diesel exhaust system, which incorporates sound attenuation. In accordance with the invention, the muffler includes an outer casing having an internal wall formed with a plurality of openings and a series of metal tubes are mounted in openings in the internal wall, while the opposite end of each tube is closed off by a second wall or partition. At least a portion of the length of each tube is formed with holes or perforations.

Mounted concentrically outward of each tube is a cylindrical catalytic trap formed of compressed stainless steel mesh, or the like, and preferably coated with a noble metal, such as platinum. Each cylindrical trap is spaced outwardly from the respective tube by engagement of the ends of the cylindrical trap with bosses formed on the internal wall and the second wall respectively.

Exhaust gas enters the inlet chamber through an inlet and flows through the openings in the internal wall into the tubes. The gas then flows through the perforations in the tube into the annular chamber between each tube and the cylindrical trap, resulting in a substantial reduction in the sound energy. The exhaust gas then flows outwardly through the cylindrical trap where the particulate material is trapped and combusted at high temperatures. The gas emerging from the cylindrical traps passes into an outlet chamber and is then discharged through an outlet.

The invention not only effectively traps and removes particulate materials in the diesel exhaust, but also acts to effectively attenuate sound. The unit is of simple construction and both the sound attenuating tubes and the cylindrical particulate traps are mounted in spaced relation through the bosses that are formed on the walls.

Other objects and advantages will appear in the course of the following description.

DESCRIPTION OF THE DRAWINGS

The drawings illustrate the best mode presently contemplated of carrying out the invention.

In the drawings:

FIG. 1 is an end view of the particulate trap exhaust muffler of the invention with parts broken away;

FIG. 3 is a section taken along line 3—3 of FIG. 2.

DESCRIPTION OF THE ILLUSTRATED EMBODIMENT

Figure 2:
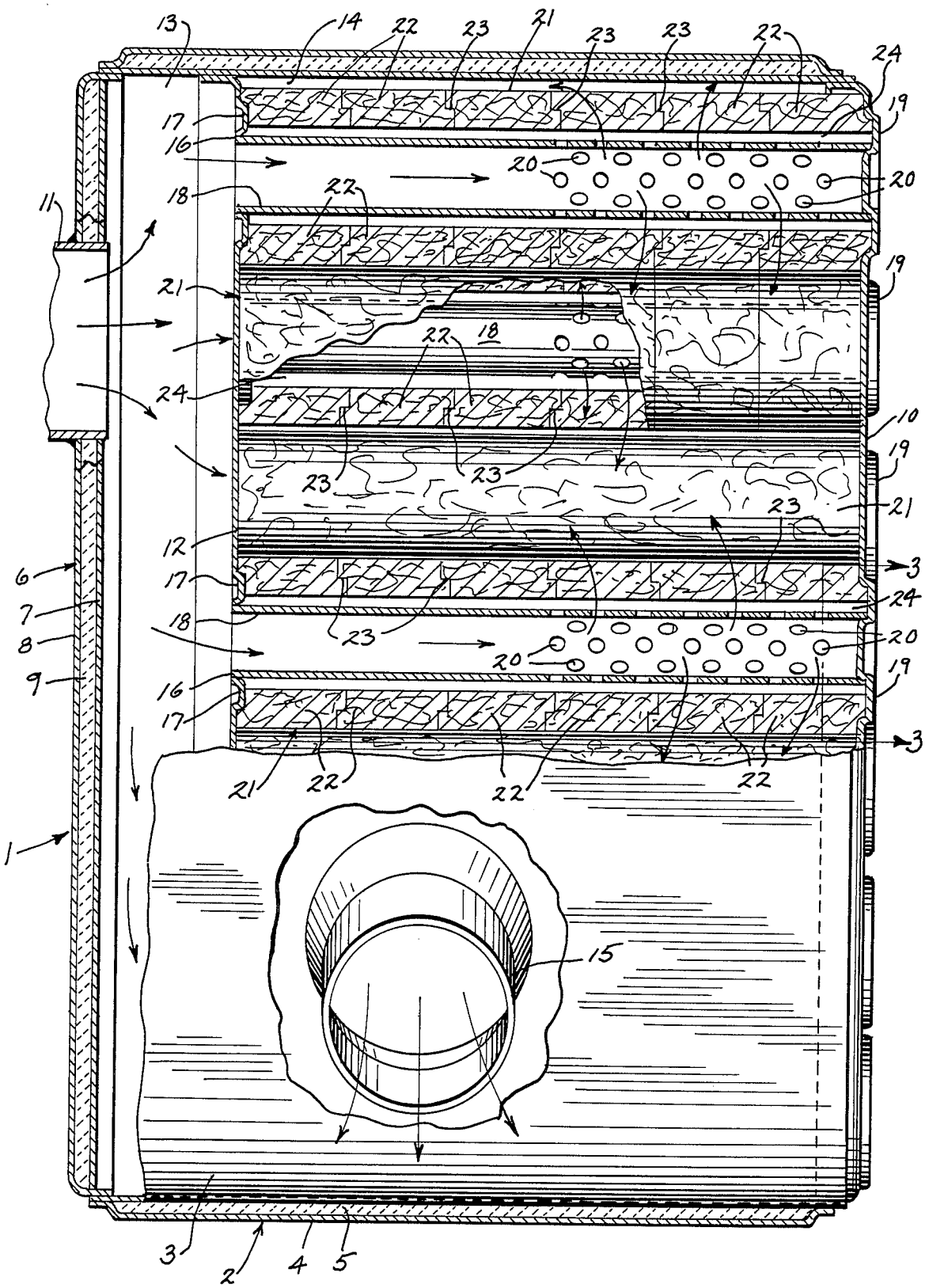
FIG. 2 is a section taken along line 2—2 of FIG. 1.

The drawings illustrate a particulate trap exhaust muffler for use with a diesel engine. The unit includes an outer casing 1, including an oval shell 2 formed of an inner wall 3, an outer wall 4 and an intermediate layer of ceramic insulation 5. One end of shell 2 is enclosed by an end wall 6 formed of an inner section 7 and outer section 8, and an intermediate layer of ceramic insulation 9. The opposite end of shell 2 is enclosed by end wall 10.

Exhaust gas is introduced into the casing 1 through an inlet 11, which is connected in end wall 6, and a divider wall 12 is secured parallel to end wall 6 divides the casing into an inlet chamber 13 and an outlet chamber 14. The gas is discharged from outlet chamber 14 through an outlet 15.

In accordance with the invention, divider wall 12 is formed with a series of openings 16, each of which is bordered by an annular boss 17. One end of a tube 18 is mounted within each of the openings 16, while the opposite end of each tube is located within an annular boss 19 formed in end wall 10. Thus, the engagement of the ends of the tubes 18 with the bosses 17 and 19 serves to locate the tubes within the outlet chamber 14.

At least a portion of the length of each tube 18 is provided with holes or perforations 20, and in the preferred form of the invention the perforations 20 are located in the rear portion of each tube, as best shown in FIG. 2. The exhaust gas entering the inlet chamber 13 through inlet 11 will flow through each of the tubes 18 and then pass outwardly through the perforations 20.

Spaced outwardly of each tube 18 is a cylindrical catalytic particulate trap 21. The trap 21, as illustrated, is formed of a series of sections 22 which are disposed in end-to-end relation and are interconnected by mating interlocking shoulders 23. Alternately, trap 21 can be an integral one-piece unit extending between walls 10 and 12. Each trap 21 is spaced outwardly of the respective tube 15 to provide an annular chamber 24 therebetween.

As best illustrated in FIG. 2, the shoulders 23 on the end sections 22 of trap 21 engage the outer edges of the respective bosses 17 and 19 to locate the cylindrical traps 21 relative to the tubes 18.

The sections 21 can be formed of compressed stainless steel mesh and can be coated with a noble metal, such as platinum or rhodium, which acts as a catalyst that will serve to burn off the trapped particulate material at elevated temperatures.

The exhaust gas entering the inlet chamber 13 through inlet 11 will flow through each of the openings 16 into the interior of the tubes 18 and then pass outwardly through perforations 20 to annular chamber 24. Passage of the exhaust gas through tubes 18 and perforations 20 produces an effective attenuation of the sound energy. The annular chamber 24 acts to distribute the gas throughout the length of the cylindrical trap 21, so that there will be a uniform gas flow radially through each trap 21. Flow of the exhaust gas outwardly through the trap 21 will trap particulate material and at high temperature operation, the particulate material will burn off.

The gas is discharged from each cylindrical trap 21 into outlet chamber 14 and is then discharged from the casing through outlet 15.

The use of the annular bosses 17 and 19 on the walls 12 and 10, respectively, provides a simple and effective manner of locating and spacing the tubes 18 and the cylindrical traps 21. Tubes 18 are engaged with the inner edges of the bosses, while the traps 21 are located by engagement with the outer edges of the bosses. This provides an effective manner of locating the members without the use of auxiliary locating members.

While the drawings have illustrated the ends of tubes 18 and traps 21 being supported by internal wall 12 and end wall 10 of casing 1, it is contemplated that in other applications the tubes and traps can be supported between a pair of spaced internal walls. It is also apparent that the downstream ends of the tubes can be closed off by separate closures or by an internal partition rather than the end wall 10 of the casing.

Various modes of carrying out the invention are contemplated as being within the scope of the following claims particularly pointing out and distinctly claiming the subject matter which is regarded as the invention.

We claim:

1. A particulate trap exhaust muffler, comprising a casing having an inlet and an outlet, an internal wall disposed within the casing, said wall having a plurality of openings, a plurality of tubes, one end of each tube communicating with one of said openings and the other end of each tube being closed, each tube having a plurality of holes extending therethrough, and a cylindrical member spaced concentrally outward of each tube, each cylindrical member being permeable to the flow of exhaust gas and being constructed and arranged to trap particulate material in the gas as said gas flows therethrough, exhaust gas entering the inlet flowing through said tubes and then outwardly through said holes and through said cylindrical members chamber for discharge from said outlet.

2. The apparatus of claim 1, wherein said tubes are disposed in parallel relation.

3. The apparatus of claim 1, wherein said internal wall is provided with a plurality of annular bosses bordering each of said openings, each boss having an inner annular edge and an outer annular edge, said tubes being engaged with said inner annular edges and the corresponding cylindrical members being engaged with the outer annular edges.

4. The apparatus of claim 1, wherein said cylindrical mnember is composed of metal mesh.

5. The apparatus of claim 1, and including a catalytic metal coating on said metal mesh.

6. The apparatus of claim 1, wherein said casing includes a second wall disposed parallel to said internal wall, said tubes and said cylindrical members being connected between said internal wall and said second wall.

7. The apparatus of claim 6, and including spacing means associated with both said internal wall and said second wall for spacing each cylindrical member in concentric relation to the respective tube.

8. An apparatus for removing particulate material and attenuating sound in the exhaust gas from a diesel engine, comprising an outer casing having an inlet and an outlet a first wall disposed within the casing, a second wall disposed generally parallel to said first wall, said first wall being provided with a plurality of openings, a plurality of tubes, one end of each tube being mounted within one of said openings and the other end of each tube being closed off by said second wall, each tube having a plurality of perforations therein, a cylindrical member spaced outwardly of each tube to provide an annular chamber therebetween, said cylindrical member being permeable to the flow of exhaust gas and being constructed and arranged to trap particulate materials in said exhaust gas, first spacing means associated with said first wall for spacing one end of each cylinder radially outward of the respective tube, and second spacing means associated with said second wall for spacing the opposite end of each cylinder radially outward of the respective tube, exhaust gas entering said inlet flowing through said tubes and then outwardly through said perforations and through said cylindrical members for discharge from said outlet.

9. The apparatus of claim 8, wherein said first spacing means comprises an annular boss disposed around each of said openings and having an inner annular edge and an outer annular edge, said inner annular edge engaged with the respective end of said tube and the outer annular edge engaged with the respective end of said cylindrical member.

10. The apparatus of claim 8, wherein said second spacing means comprises a plurality of annular bosses formed on said second wall and having an inner peripheral edge and an outer peripheral edge, one end of each tube being engaged with the inner peripheral edge of a corresponding boss and one end of each cylindrical member being engaged with the outer peripheral edge of the respective boss.

11. The apparatus of claim 8, wherein each cylindrical member is composed of a group of axially aligned abutting annular sections.

12. The apparatus of claim 11, wherein abutting surfaces of said sections are provided with mating shoulders.

13. The apparatus of claim 12, wherein the shoulders on the end sections of said group are engaged with said first and second spacing means.

14. The apparatus of claim 8, wherein said second wall constitutes an end wall of the casing.

* * * * *

UNITED STATES PATENT AND TRADEMARK OFFICE

CERTIFICATE OF CORRECTION

PATENT NO. : 4,712,643

DATED : December 15, 1987

INVENTOR(S) : LAWRENCE F. ILES ET AL

It is certified that error appears in the above-identified patent and that said Letters Patent is hereby corrected as shown below:

Col. 3, CLAIM 1, Line 49, After "members" delete "chambers"; Col. 4, CLAIM 8, Line 27, Cancel "cylinder" and substitute therefor ---cylindrical member---; Col. 4, line 30, CLAIM 8, cancel "cylinder" and substitute therefor ---cylindrical member ---.

Signed and Sealed this

Twenty-first Day of February, 1989

*Attest:*

DONALD J. QUIGG

*Attesting Officer*

*Commissioner of Patents and Trademarks*